US010507485B2

(12) United States Patent
Farrell et al.

(10) Patent No.: US 10,507,485 B2
(45) Date of Patent: Dec. 17, 2019

(54) DRYING SYSTEM EMPLOYING COMPRESSED AIR

(71) Applicant: Toyota Motor Engineering & Manufacturing North America, Inc., Erlanger, KY (US)

(72) Inventors: Eric J. Farrell, Woodstock (CA); James A. Sleightholm, St. Thomas (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 8 days.

(21) Appl. No.: 15/403,720

(22) Filed: Jan. 11, 2017

(65) Prior Publication Data

US 2018/0193866 A1 Jul. 12, 2018

(51) Int. Cl.

| | |
|---|---|
| ***B05B 15/55*** | (2018.01) |
| ***F26B 21/00*** | (2006.01) |
| ***B05B 1/20*** | (2006.01) |
| ***B05B 1/00*** | (2006.01) |

(52) U.S. Cl.

CPC ..... *B05B 15/55* (2018.02); *F26B 21/004* (2013.01); *B05B 1/005* (2013.01); *B05B 1/205* (2013.01)

(58) Field of Classification Search

None

See application file for complete search history.

(56) References Cited

U.S. PATENT DOCUMENTS

2016/0288145 A1 10/2016 Zumberger et al.

FOREIGN PATENT DOCUMENTS

| | | | | |
|---|---|---|---|---|
| FR | 2284688 | * 12/1989 | ..... | B08B 3/022 |
| JP | H01300525 | * 4/1976 | ..... | F26B 21/00 |

OTHER PUBLICATIONS

English Translation of JPH01300525, accessed on Jun. 2018. (Year: 1989).*

English Translation of FR2284688, accessed on Jun. 2018. (Year: 1976).*

* cited by examiner

*Primary Examiner* — Eric W Golightly

*Assistant Examiner* — Arlyn I Rivera-Cordero

(74) *Attorney, Agent, or Firm* — Christopher G. Darrow; Darrow Mustafa PC

(57) ABSTRACT

A drying device that includes a series of hollow tube sections connected sequentially end-to-end to form a helical-shaped manifold. Each hollow tube section includes a plurality of apertures used for producing air jets. The apertures fluidly connect internal passages in the hollow tube sections to an external region surrounding the manifold. The apertures are oriented to direct the air jets toward a center region of the manifold. Each hollow tube section is oriented at an oblique angel relative to a respective reference plane to produce the helical-shaped manifold.

10 Claims, 8 Drawing Sheets

DRYING SYSTEM EMPLOYING COMPRESSED AIR

BACKGROUND

Undesirable vibration energy occurs in a variety of products and devices. For example, in automotive vehicles, the engine and other automotive systems can cause vibration to permeate through the vehicle body and into the vehicle's passenger compartment. Similar undesirable vibration energy occurs in a variety of other situations, such as in household appliances and other types of transportation vehicles, to name a few.

To reduce undesirable vibration energy, vibration damping materials may be applied to the surfaces of mechanical components subjected to vibrational disturbances. Such damping materials dissipate a portion of the vibrational energy applied to them. For vehicle applications, such damping materials may be applied to a number of surfaces of the vehicle panels, floors, etc., to reduce the vibration or noise felt by the vehicle occupant.

The damping material may be formulated as a water based coating that can be sprayed onto a panel using a robotically controlled spray head. To prevent the damping material from drying on the spray head when not in use, and potentially clogging nozzle openings in the spray head, the spray head may be submerged in a liquid bath, such as deionized water. Compressed air jets may be used to blow off excess water from the spray head prior to commencing spraying. This could result in water being inadvertently blown onto nearby vehicle panels, which could cause undesirable defects in subsequently applied coatings, such as paint.

SUMMARY

Disclosed is a drying system that utilizes a series of strategically positioned air jets for removing a liquid from a surface of an object. The drying system employs a helical-shaped manifold that generates multiple air jets directed toward a center region of the manifold that blow the liquid from the object as it passes through manifold. The manifold may be constructed from a hollow tube formed in a shape of a helix. The air jets create an air vortex that tends to entrain the liquid blown from the object and prevent it from being deposited on nearby objects.

BRIEF DESCRIPTION OF THE DRAWINGS

The various features, advantages and other uses of the present apparatus will become more apparent by referring to the following detailed description and drawings, in which.

DETAILED DESCRIPTION

Figure 1:
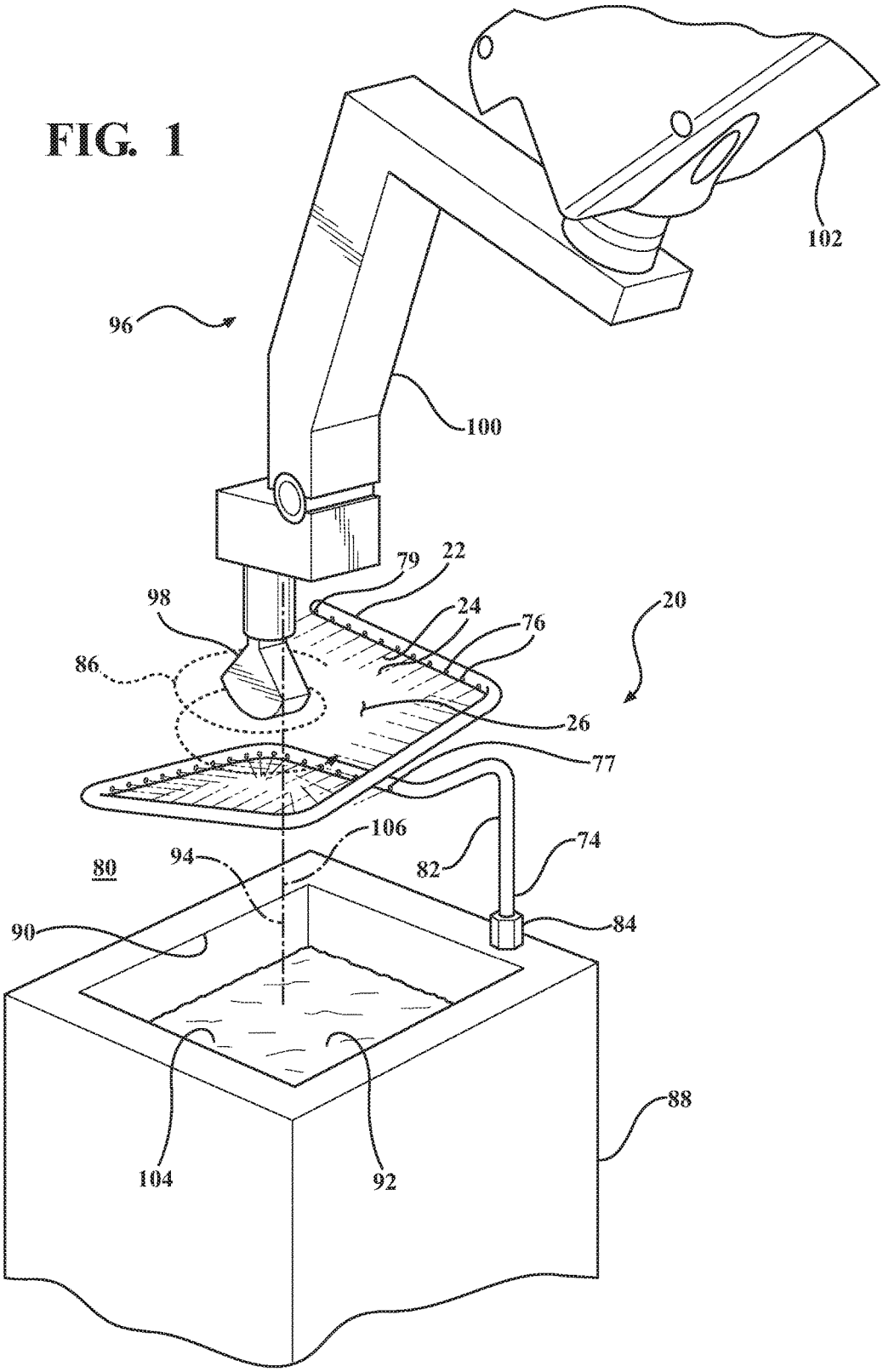
FIG. 1 is a perspective view of a drying system that may be used in connection with an automated spraying apparatus.

A drying system employing compressed air to remove liquid from an exterior of an object is disclosed. The drying system employs strategically positioned jets of compressed air to blow the liquid from a surface of the object while avoiding having the liquid splashed onto nearby surfaces. Previously designed systems using air jets to remove liquid from an object tend to blow the liquid onto surrounding objects. This can be particularly problematic in manufacturing operations, such as those involving application of automotive coatings, where stray liquid can cause defects in an applied spray coating. For example, automotive vehicles may have a vibration damping material sprayed onto various vehicle panels during assembly. The damping material may be formulated as a water based coating that can be sprayed onto a panel using a robotically controlled spray head. To prevent the damping material from drying on the spray head when not in use, and potentially clogging nozzle openings in the spray head, the spray head may be submerged in a liquid bath, such as deionized water. Compressed air jets may be used to blow off excess water from the spray head prior to commencing spraying. This could result in water being inadvertently blown onto nearby vehicle panels, which could cause undesirable defects in subsequently applied coatings, such as paint. To avoid this, the present drying system utilizes a series of strategically positioned air jets to remove the water from the spay head prior to spraying. The air jets may be arranged along a helix to create an air vortex that tends to entrain the liquid blown from the spray head and prevent it from being deposited on nearby objects.

Referring now to the discussion that follows and the drawings, illustrative approaches to the disclosed systems and methods are described in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

With reference to FIG. 1, a drying system 20 for removing liquid from an exterior of an object utilizes multiple jets of compressed fluid, such as air, to blow the liquid from the object as it moves through drying system 20. For purposes of discussion, the drying system 20 will be described as employing compressed air, but may also be used with other compressed liquids and gasses. Drying system 20 may employ a helical-shaped manifold 22 to generate multiple air jets 24 directed toward a center region 26 of manifold 22 that blow the liquid from the object as it passes through manifold 22. Manifold 22 may be constructed from a hollow tube formed in a shape of a rectangular helix. A helix portion 28 of manifold 22 may be formed from a continuous length of tube and include multiple straight sections 30 interconnected by curved sections 32. The straight sections 30 define edges of the rectangular helix portion 38 of manifold 22. Alternately, manifold 22 may be constructed from several straight sections of tubing interconnected end-to-end, either directly or by way of a suitably configured couplings.

In the illustrated example, helix portion 28 of manifold 22 includes five interconnected hollow tube sections. The hollow tube sections may be arranged end-to-end, and include a first hollow tube section 34 having a first end 36 and an opposite second end 38; a second hollow tube section 40 having a first end 42 fluidly connected to second end 38 of first hollow tube section 34 and an opposite second end 44; a third hollow tube section 46 having a first end 48 fluidly connected to second end 44 of second hollow tube section 40 and an opposite second end 50; a fourth hollow tube section 52 have a first end 54 fluidly connected to second end 50 of third hollow tube section 46 and an opposite second end 56; and a fifth hollow tube section 58 have a first end 60 fluidly connected to second end 56 of fourth hollow tube section 52 and an opposite second end 62. Each of the hollow tube sections 34,40,46,52,58 may be oriented substantially perpendicular to an immediately adjacent hollow tube section to form the rectangular-shaped helix.

Figure 4:
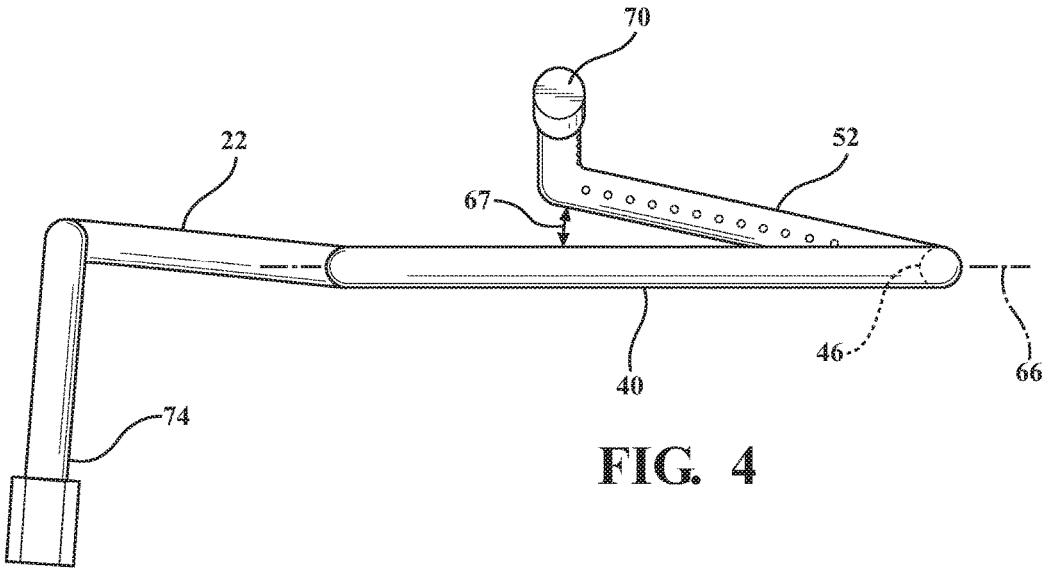
FIG. 4 is a side elevation view of the manifold viewed along a third hollow tube section of the manifold.
Figure 5:
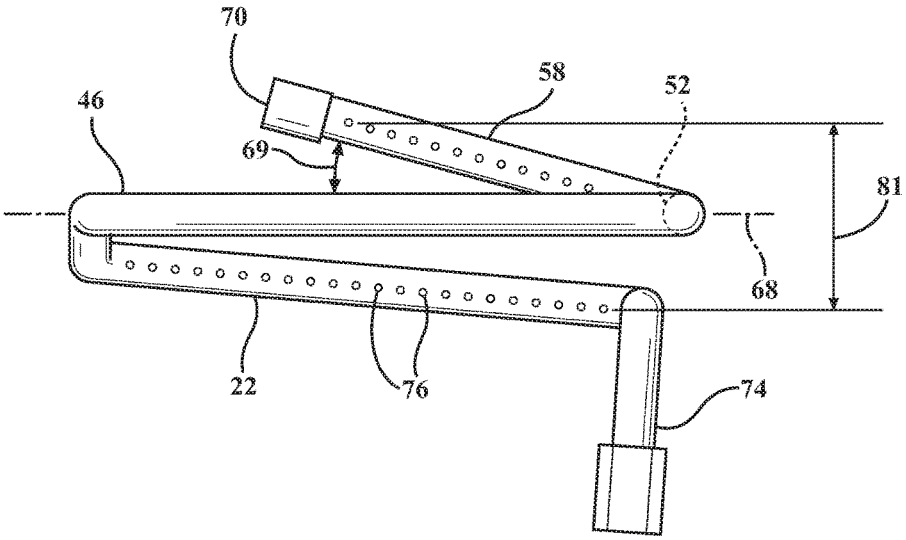
FIG. 5 is a side elevational view of the manifold viewed along a fourth hollow tube section of the manifold.
Figure 7:
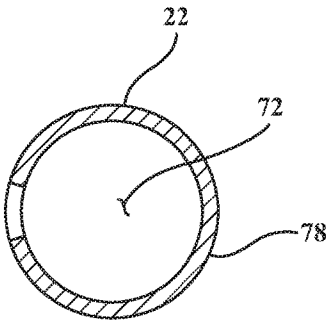
FIG. 7 is a partial cross-sectional view of the manifold taken along section line 7-7 of FIG. 2.
Figure 6:
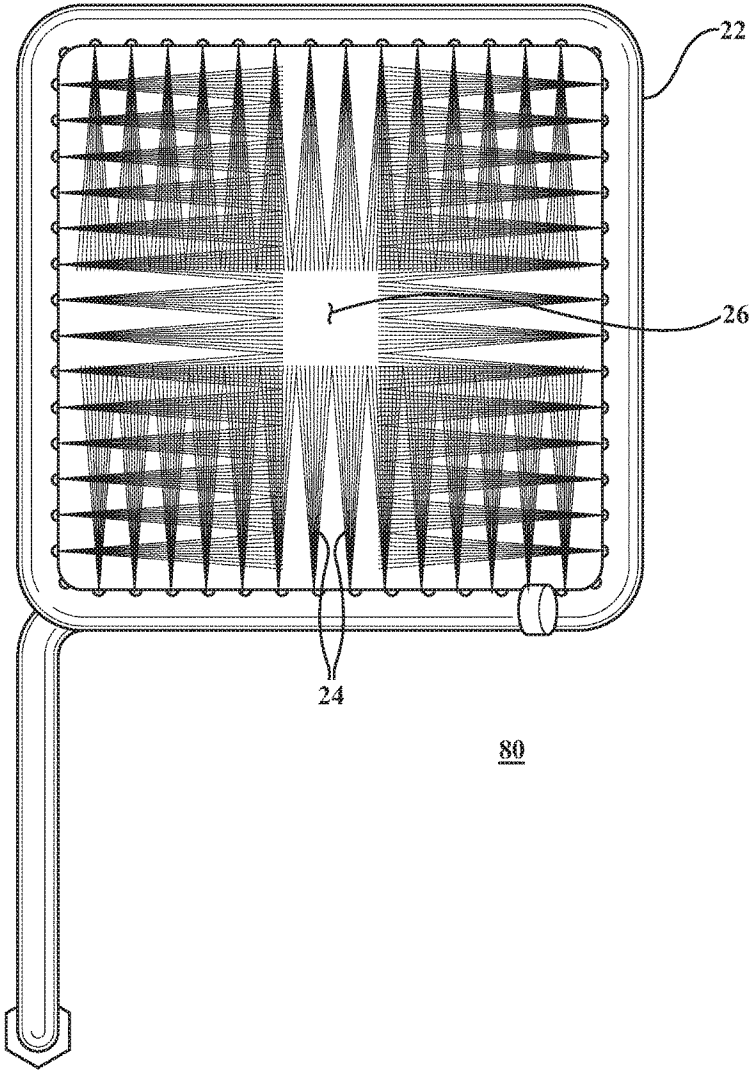
FIG. 6 is a top elevational view of the manifold.

With reference to FIGS. 2-5, helix portion 28 of manifold 22 may be formed by orienting each of the straight hollow tube sections 34,40,46,52,58 at an incline relative to a reference plane. For example, with reference to FIG. 3, first and second hollow tube sections 34 and 40 may together define a first reference plane 64. To create the helix shape of manifold 22, third hollow tube section 46 may be oriented at an oblique angle 65 relative to first reference plane 64 while generally maintaining the perpendicular orientation between second and third hollow tube sections 40 and 46. With reference to FIG. 4, second and third hollow tube sections 40 and 46 may together define a second reference plane 66, with fourth hollow tube section 52 being oriented at an oblique angle 67 relative to second reference plane 66 while generally maintaining the perpendicular orientation between third and fourth hollow tube sections 46 and 52. With reference to FIG. 5, with third and fourth hollow tube sections 46 and 52 may together define a third reference plane 68, with fifth hollow tube section 58 being oriented at an oblique angle 69 relative to third reference plane 68 while generally maintaining the perpendicular orientation between fourth and fifth hollow tube sections 52 and 58. Arranging the hollow tube sections 34,40,46,52,58 in this manner results in the helix-shaped manifold 22, in which third hollow tube section 46 and fifth hollow tube section 58 may be located on opposite sides of center region 26 and second hollow tube section 40 and fourth hollow tube section 52 may be located on opposite sides of center region 26. First hollow tube section 34 and fifth hollow tube 58 may be located on a common side of center region 26 and opposite third hollow tube section 46. Fifth hollow tube section 58 at least partially overlaps first hollow tube section 34, but at no point does fifth hollow tube section 58 contact first hollow tube section 34.

The five interconnected hollow tube sections 34,40,46,52,58 form one pitch of the helix portion 28 of manifold 22. The helix may be extended by adding additional straight sections of hollow tubing, which may be connected end-to-end starting with second end 62 of fifth hollow tube section 58. Each of the additional tube sections may be oriented generally perpendicular to an immediately adjacent hollow tube section, as well as being oriented at an oblique angle relative to a corresponding reference plane in the manner previously described in connection with the hollow tube sections 34,40,46,52,58.

Figure 2:
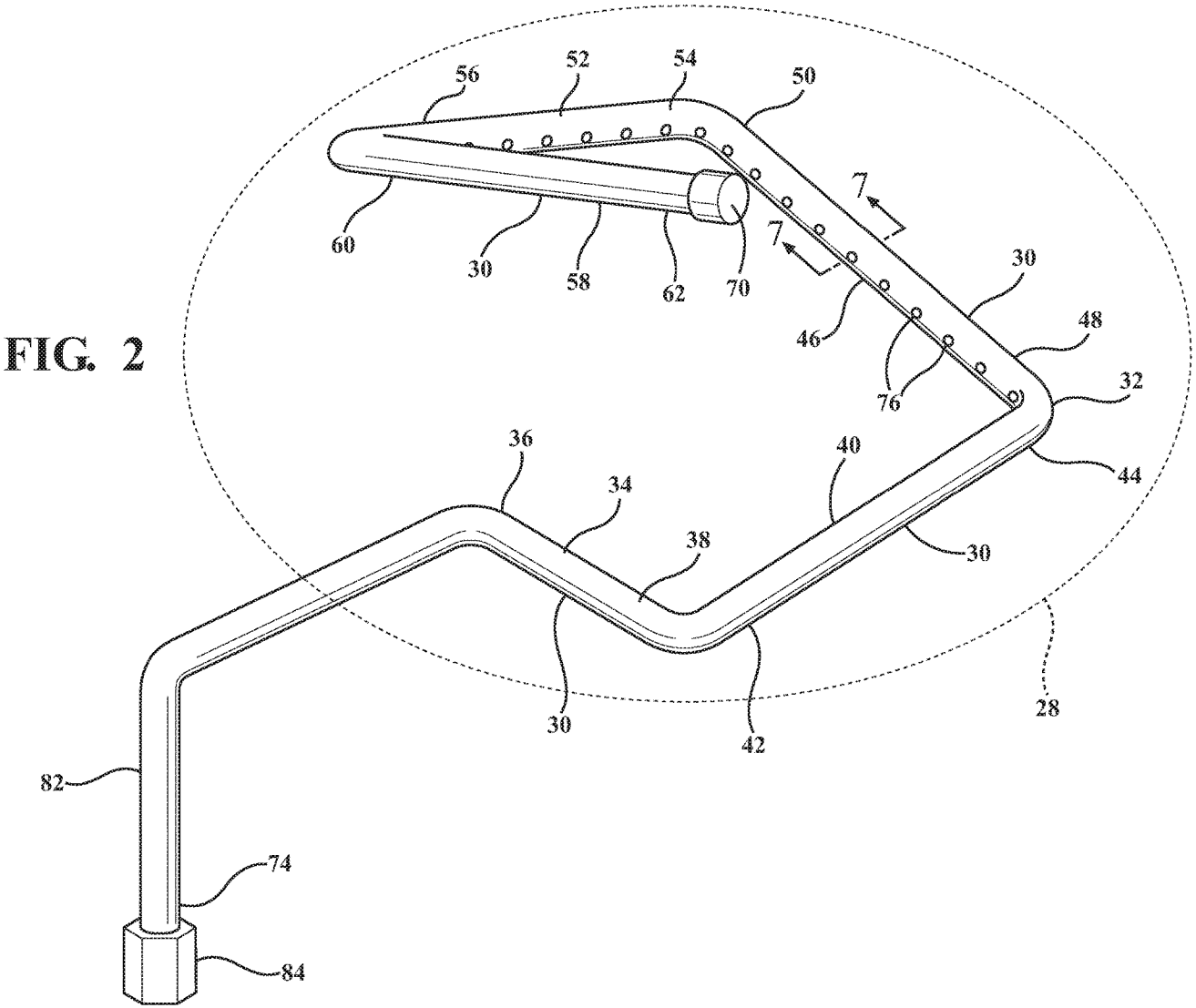
FIG. 2 is a perspective view of a manifold that may be employed with the drying system of FIG. 1.
Figure 3:
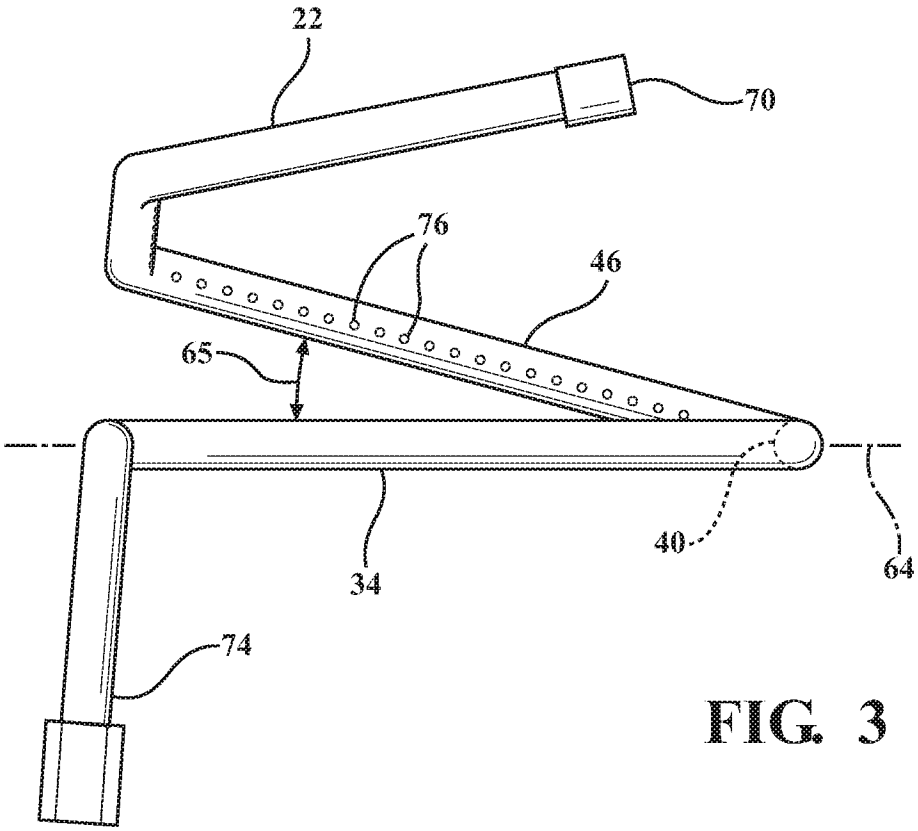
FIG. 3 is a side elevational view of the manifold viewed along a second hollow tube section of the manifold.

With reference to FIG. 2, an end of the last hollow tube section, which in the illustrated example is second end 62 of fifth hollow tube section 58, may be closed to prevent compressed air from being discharged from the end of the hollow tube section. A cap 70, or another suitably configured closure device, may be used to seal off second end 62 of fifth hollow tube section 58.

With reference to FIGS. 1-7, manifold 22 may include an internal passage 72 for transporting the compressed air through manifold 22. The compressed air flows through manifold 22 in a direction progressing from a manifold inlet 74 to second end 62 of fifth hollow tube section 58. Manifold 22 may include a plurality of apertures 76 that extend entirely through a wall 78 of each of the hollow tube sections 34,40,46,52,58 to fluidly connect internal passage 72 to an exterior region 80 of manifold 22. Compressed air passing through manifold 22 may be discharged from apertures 76 to form air jets 24 used to blow fluid from an exterior of an object as it passes through center region 26 of manifold 22. The hollow tube sections 34,40,46,52,58 generally define an outer periphery of center region 26. Apertures 76 may be arranged linearly along a length of each of the hollow tube sections 34,40,46,52,58. Apertures 76 may be oriented to direct air jets 24 toward center region 26 of manifold 22. Apertures 76 may include a beginning aperture 77 and an ending aperture 79 located downstream of beginning aperture 77. Ending aperture 79 may be spaced a distance 81 from beginning aperture 77 along longitudinal axis 94 of the manifold 22.

Manifold 22 may be fluidly connected to a pressurized air source. In the illustrated example, a length of hollow tubing 82 is used to connect helix portion 28 of manifold 22 to the pressurized air source. Hollow tubing 82 may include various bends and turns to accommodate a particular application. A suitably configured connector 84 may be used to secure manifold 22 to the pressurized air source. It is not necessary that manifold 22 be rigidly connected to the pressurized air source, and various flexible and semi-flexible hoses and/or tubes may be used to fluidly connect manifold 22 to the pressurized air source.

With reference to FIG. 1, the helical configuration of manifold 22 and the arrangement of the of apertures 76 in the hollow tube sections 34,40,46,52,58 cause the air jets 24 to produce an air vortex 86. Fluid blown from the surface of the object passing through center region 26 of manifold 22 tends to become entrained in air vortex 86 and is generally prevented from being splashed onto surrounding surfaces. This enables drying system 20 to be used in close proximity to workpieces without risking contaminating the workpieces prior to applying a subsequent spray coating.

Drying system 20 may include a liquid storage container 88 located adjacent manifold 22. Liquid storage container 88 may include an opening 90 for providing access to an interior of liquid storage container 88 and any liquid 92 present within the container. The manifold may be positioned adjacent opening 90, with a longitudinal axis 94 of manifold 22 oriented to extend through opening 90. In the illustrated example, manifold 22 is located above opening 90 with longitudinal axis 94 oriented generally vertically. Manifold 22 may alternatively be positioned at a different location relative to liquid storage container 88 and opening 90.

With reference to FIGS. 1-6, drying system 20 may be used in variety of applications. For example, it may be used with an automatic spray system 96 for apply a liquid damping material to automotive vehicle panels. The damping material may be applied to the vehicle panels using a spray head 98 attached to robotic arm 100. A robot 102 may control operation of the robotic arm 100 and spray head 98. The damping material may have a relatively quick dry time. To avoid having the damping material dry on spray head 98 and potentially clog spray nozzles in the spray head when not in use, spray head 98 may be submerged in a liquid bath 104 present within liquid storage container 88. Liquid bath 104 may include deionized water. After applying the damping material to a vehicle panel, robot 102 may proceed to submerge spray head 98 in liquid bath 104 by positioning spray head 98 above manifold 22. Robot 102 may then move spray head 98 along a path of travel 106 that extends through center region 26 of manifold 22 and generally coincides with longitudinal axis 94 of manifold 22. Robot 102 moves spray head 98 through opening 90 in liquid storage container 88 and submerges spray head 98 in liquid bath 104. Spray head 98 may remain submerged in liquid bath 104 until commencing the next spraying operation.

To commence spraying, robot 102 removes spray head 98 from liquid bath 104 and proceeds to move spray head 98 along path of travel 106 and past manifold 22 to allow air jets 24 to blow water from spray head 98. The water residue may become entrained in air vortex 86 generated by air jets 24 and transported back to liquid storage container 88 where it can be deposited for subsequent use. Spray head 98 is now in a condition to commence spraying damping material onto the vehicle panels.

Although described in connection with an automotive spray coating operation, drying system 20 may also be used to effectively remove liquids from a variety of objects. Air vortex 86 generated by air jets 24 emanating from manifold 22 tends to entrain liquid blown from the surface of the object and helps prevent the fluid from being deposited on surrounding surfaces.

In addition to being configured as a rectangular helix, the helix portion of the manifold may be alternatively configured to have a different geometric shape. For example, the manifold helix may be configured as a triangular helix, polygonal helix, a round helix, or another geometric shape. It is not necessary that the helix have a single geometric shape, and may include a combination of geometries. Depending on the geometric shape of the helix, the manifold may include a series of straight sections, curved sections, or combination thereof.

Figure 8:
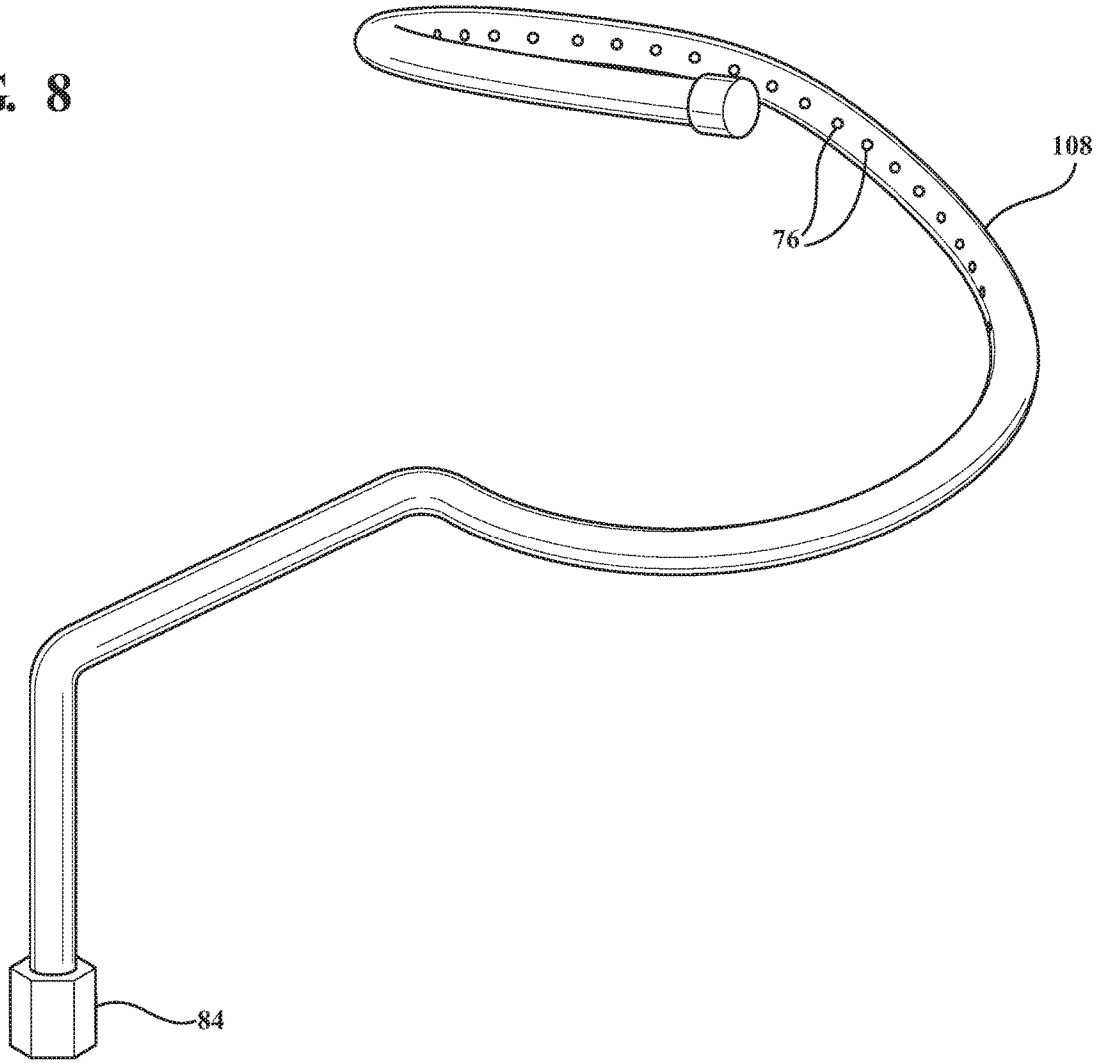
FIG. 8 is a perspective view of an alternately configured manifold that may be employed with the drying system.
Figure 9:
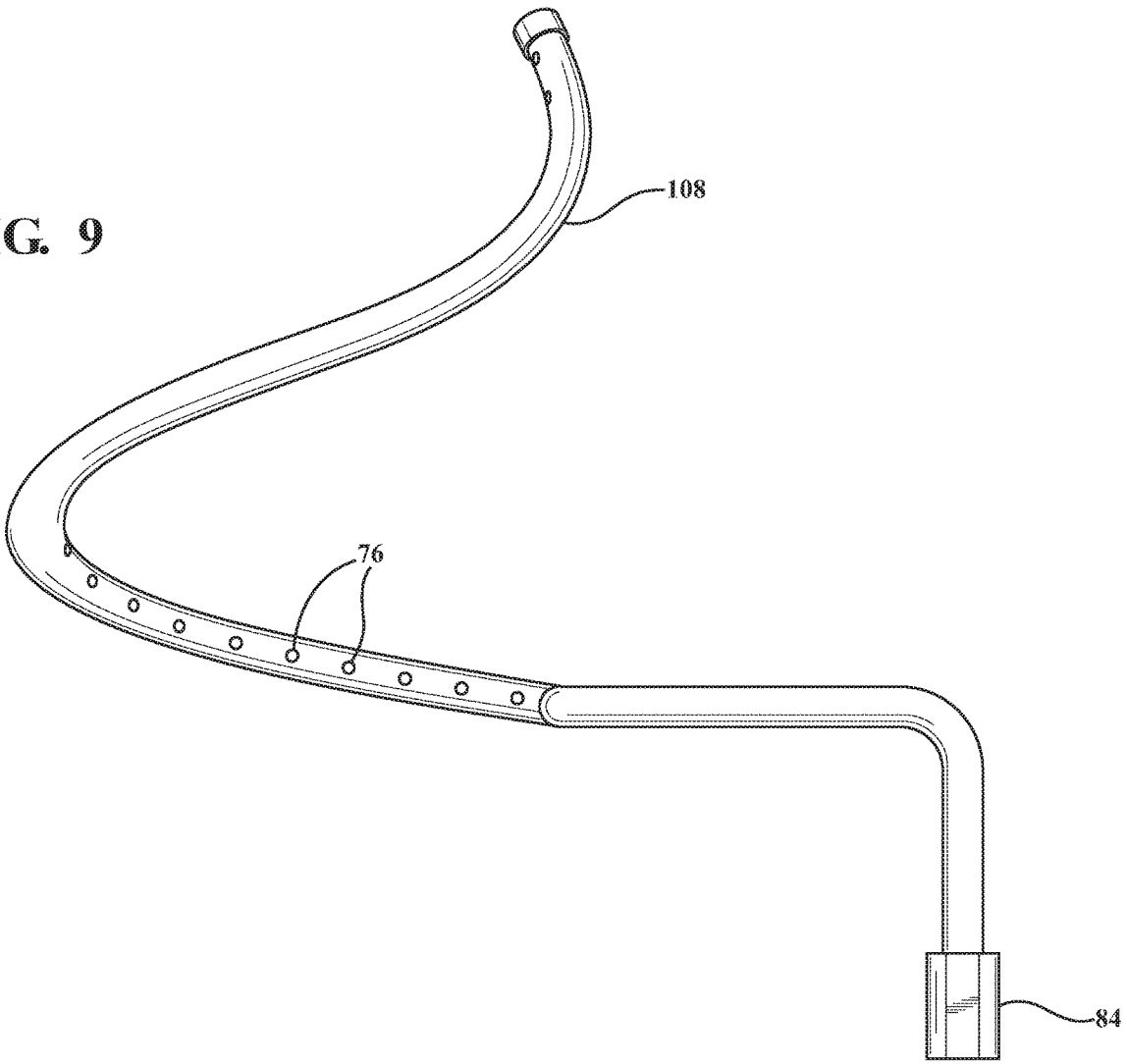
FIG. 9 is a side elevational view of the alternately configured manifold.
Figure 10:
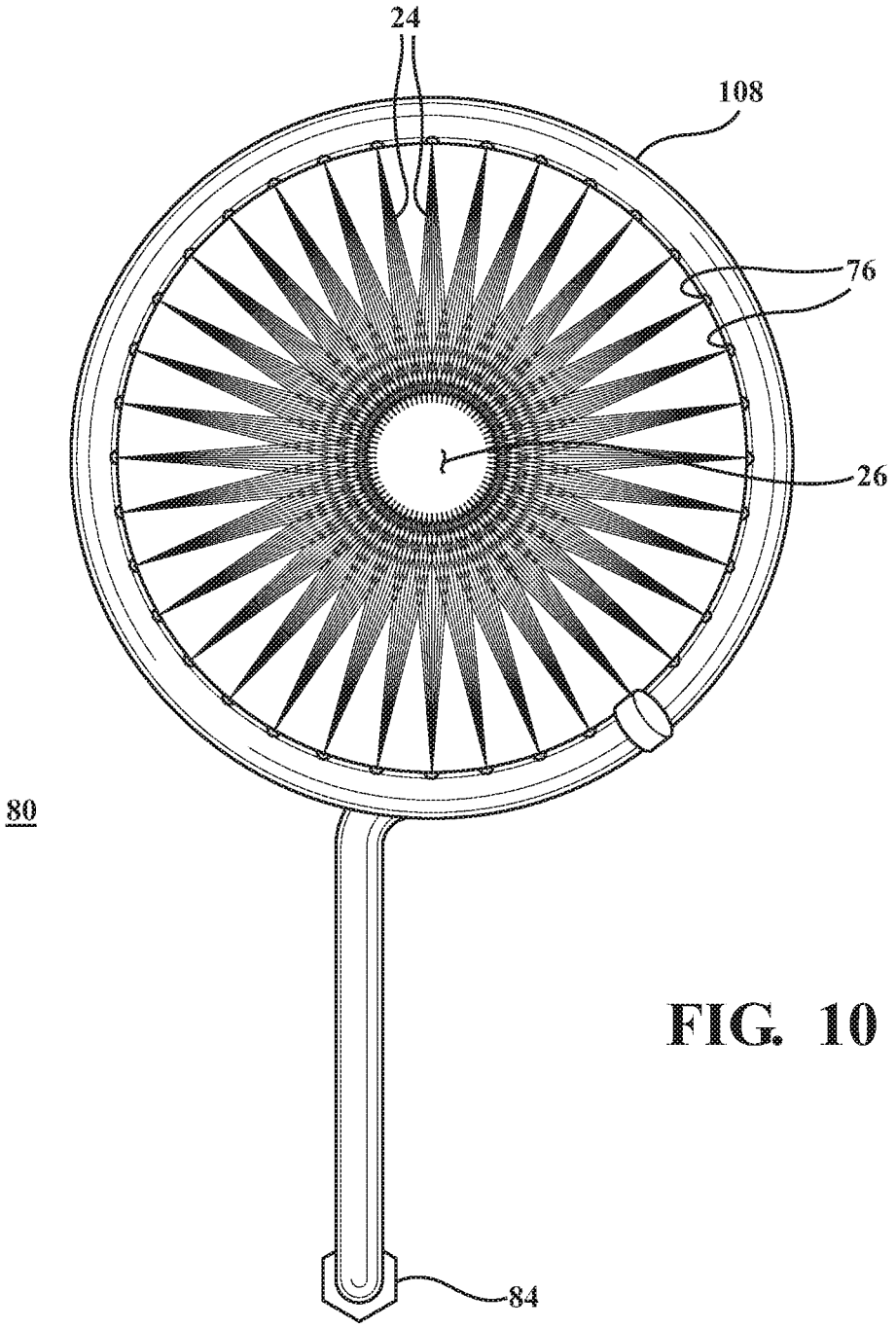
FIG. 10 is a top elevational view of the alternately configured manifold.

For example, FIGS. 8-10, illustrate a manifold 108 configured as a circular helix. Manifold 108 may have a similar configuration as the rectangular helix of manifold 22, as illustrated, for example, in FIGS. 1-6, but instead of employing straight hollow tube sections to form a rectangular helix, manifold 108 may utilize a continuous curved section of hollow tubing to produce the circular helix. Like the rectangular helix of manifold 22, manifold 108 may include the plurality of apertures 76 arranged linearly along a length of the curved portion of the manifold. Apertures 76 fluidly connect internal passage 72 of manifold 108 (see for example, FIG. 7) to external region 80 of manifold 108. Apertures 76 may be oriented to direct air jets 24 streaming from apertures 76 toward center region 26 of manifold 108. Manifold 108 may include connector 84 for connecting manifold 108 to the compressed air source. Manifold 108 may be operated in a similar manner as manifold 22 (as illustrated for example in FIG. 1).

An alternately configured manifold having different geometrically-shaped helix may also be employed, provided the manifold is configured as a helix and includes apertures oriented to direct air jets toward a center region of the manifold.

It is intended that the scope of the present methods and apparatuses be defined by the following claims. However, it must be understood that the disclosed systems and methods may be practiced otherwise than is specifically explained and illustrated without departing from its spirit or scope. It should be understood by those skilled in the art that various alternatives to the configurations described herein may be employed in practicing the claims without departing from the spirit and scope as defined in the following claims. The scope of the disclosed systems and methods should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. Furthermore, all terms used in the claims are intended to be given their broadest reasonable constructions and their ordinary meanings as understood by those skilled in the art unless an explicit indication to the contrary is made herein. In particular, use of the singular articles such as "a," "the," "said," etc., should be read to recite one or more of the indicated elements unless a claim recites an explicit limitation to the contrary. It is intended that the following claims define the scope of the device and that the method and apparatus within the scope of these claims and their equivalents be covered thereby. In sum, it should be understood that the device is capable of modification and variation and is limited only by the following claims.

What is claimed is:

1. A method of drying an object using a drying system employing compressed air, the method comprising:

connecting a coil-shaped tube to a compressed air source, the coil-shaped tube including an internal passage for transporting the compressed air and a plurality of apertures fluidly connecting the internal passage of the coil-shaped tube to an exterior region of the coil-shaped tube, the coil-shaped tube including a plurality of straight sections, the plurality of apertures oriented to discharge the compressed air from each aperture of the plurality of apertures in a direction perpendicular to a straight section of the plurality of straight sections containing the apertures and toward a center region of the coil-shaped tube so as to generate a vortex within the center region of the coil-shaped tube, the vortex being configured to direct a liquid removed from the surface of the object in a first direction;

discharging a stream of compressed air from the plurality of apertures; and moving an object to be dried through the coil-shaped tube and the stream of compressed air in a second direction opposite the first direction, along a path of travel coinciding with a longitudinal axis of the coil-shaped tube.

2. The method of claim 1, further comprising moving the object through the coil-shaped tube prior to submersing the object in the liquid.

3. The method of claim 1, further comprising:

submersing the object in a liquid present within a liquid storage container located adjacent the coil-shaped tube, the longitudinal axis of the coil-shaped tube oriented to extend through an opening in the liquid storage container, the opening providing the object access to the liquid present within the liquid storage container; and removing the object from the liquid prior to moving the object through the coil-shaped tube and the steam of compressed air.

4. The method of claim 3, wherein the step of submersing the object comprises the step of moving the object in the first direction into the liquid present within the liquid storage container, and wherein the step of removing the object from the liquid comprises the step of moving the object in the second direction.

5. The method of claim 1, wherein the second direction is a direction away from a liquid storage container configured for receiving therein the liquid removed from the surface of the object to be dried.

6. The method of claim 5, wherein the liquid storage container is configured to enable access to an interior of the liquid storage container by the object to be dried.

7. The method of claim 1, wherein the plurality of apertures is oriented to discharge the compressed air toward the center region of the coil-shaped tube so as to remove the liquid from the surface of the object as the object moves in the second direction along the path of travel.

8. The method of claim 7, wherein the vortex is configured to entrain therein the liquid removed from the surface of the object as the object moves along the path of travel.

9. The method of claim 8, wherein the plurality of apertures is oriented to discharge the compressed air toward the center region of the coil-shaped tube such that the vortex is configured to direct the liquid removed from the surface of the object into a liquid storage container located adjacent the coil-shaped tube.

10. The method of claim 9, further comprising the step of, prior to discharging a stream of compressed air from the plurality of apertures, locating the coil-shaped tube above an opening of the liquid storage container such that a longitudinal axis of the coil-shaped tube extends through the opening of the liquid storage container.

* * * * *